United States Patent [19]

Gay et al.

[11] 4,215,843

[45] Aug. 5, 1980

[54] TOY MOLDING APPARATUS AND MATERIAL FOR USE THEREWITH

[75] Inventors: Derek J. Gay, Rancho Palos Verdes; Robert G. Trout, Huntington Beach; Manuel G. Y. Chin, Santa Ana; James E. Sawyer, Irvine, all of Calif.

[73] Assignee: Mattel, Inc., Hawthorne, Calif.

[21] Appl. No.: 878,855

[22] Filed: Feb. 17, 1978

[51] Int. Cl.[3] ..... B22D 27/02

[52] U.S. Cl. ..... 249/78; 99/426; 219/220; 219/421; 219/432; 219/521; 249/79; 249/117; 425/317; 425/447; 425/DIG. 57

[58] Field of Search ..... 249/78, 79, 117; 425/DIG. 57, 317, 447; 106/136; 219/421, 220, 432, 521; 99/426

[56] References Cited

U.S. PATENT DOCUMENTS

| | | | |
|---|---|---|---|
| 1,248,532 | 12/1917 | Noyes | 425/317 |
| 2,458,728 | 1/1949 | Phlak | 425/317 |
| 2,532,489 | 12/1950 | Ferguson | 106/136 |
| 2,770,553 | 11/1956 | Weidenheimer et al. | 106/136 |
| 3,309,738 | 3/1967 | Friedman | 425/DIG. 57 |
| 3,921,801 | 11/1975 | Sway | 425/DIG. 57 |
| 4,011,036 | 3/1977 | Bichet | 425/447 X |

OTHER PUBLICATIONS

Kirk-Othmer, Encyclopedia of Chemical Technology, 2nd Edition, vol. 10, 1967, pp. 499-502.

*Primary Examiner*—Howard E. Schain
*Attorney, Agent, or Firm*—John G. Mesaros; Max E. Shirk; Ronald M. Goldman

[57] ABSTRACT

A toy molding apparatus having a housing or container with a heat source therein surrounded by a heat directing baffle member, at least a portion of the baffle member being configured for receiving a plastic squeeze bottle containing a gelatinous substance therein, the substance being generally solid at room temperature and approaching a liquid state at approximately 105° Fahrenheit. The bottle is positioned within the receptacle for heating by the heat source and upon reaching a fluid state it is poured into a separate mold member to set upon cooling.

9 Claims, 5 Drawing Figures

TOY MOLDING APPARATUS AND MATERIAL FOR USE THEREWITH

BACKGROUND OF THE INVENTION

The background of the invention will be discussed in two parts:

1. Field of the Invention

This invention relates to toys, and more particularly to a toy for using a gelatinous substance to mold play figures.

2. Description of the Prior Art

Toys which enable children to make toy figures of a flexible or edible character have become popular. Generally, such toys include a chemical composition, which may be conveniently contained within a plastic squeeze bottle, which composition adopts certain characteristics in response to changes, such as temperature or pressure. Conveniently, such toys will include molds having patterns embossed therein for the creation of toy figures or creatures which may simulate insects, monsters, or science-fiction type characters. Such molds may be one or two parts, that is having a single cavity into which the composition is poured or may be two-sided to create a three dimensional object wherein the two sides of the mold have mating cavities configured to create a given object.

In such a toy molding apparatus, heat is generally required, the heat usually taking the form of an electrical light bulb which necessitates connection to normal household alternating current. The heat from such heat sources is usually concentrated and certain precautions must be taken with respect to the use of such objects or toys by children.

Accordingly, it is an object of this invention to provide a new and improved toy molding apparatus and material for use therewith.

It is another object of this invention to provide a new and improved toy molding apparatus having a baffle member generally surrounding the heat source.

It is a further object of this invention to provide a new and improved chemical composition for use with toy molding apparatus, the composition setting at room temperature.

SUMMARY OF THE INVENTION

The foregoing and other objects of the invention are accomplished by providing a toy molding apparatus having a housing in the form of a pail with a low wattage electrical light source thermostatically controlled and generally centrally located in the bottom of the housing. A baffle member generally substantially surrounds the heat source with the baffle member containing one or more receptacles for receiving a plastic squeeze bottle containing a chemical substance. The housing is provided with a cover for retaining the heat within the housing during heating of the bottle to a temperature generally between 110° Fahrenheit and 130° Fahrenheit. A separate mold is provided with one or more cavities for receiving the composition in fluid form to mold toy figures or creatures.

The material is a gelatinous substances which is generally solid at room temperature with a melting temperature commencing at approximately 98–100° Fahrenheit with the composition or material becoming more fluid as the temperature arises above that until at approximately 130° Fahrenheit, the material has a viscosity closely approaching that of water. When fluid, the material is ejected from the bottle into the mold cavities for setting generally at room temperature. The material includes edible gelatin in a range of 18 to 35 percent by weight with glycerin in a range of 10–25 percent by weight with water approximately 55 percent by weight on the average, with a mixture of anti-bacterial preservatives and color pigments.

Other objects, features and advantages of the invention will become apparent from a reading of the specifications when taken in conjunction with the drawings in which like reference numerals refer to like elements in the several views.

DESCRIPTION OF THE PREFERRED EMBODIMENT

Figure 1:
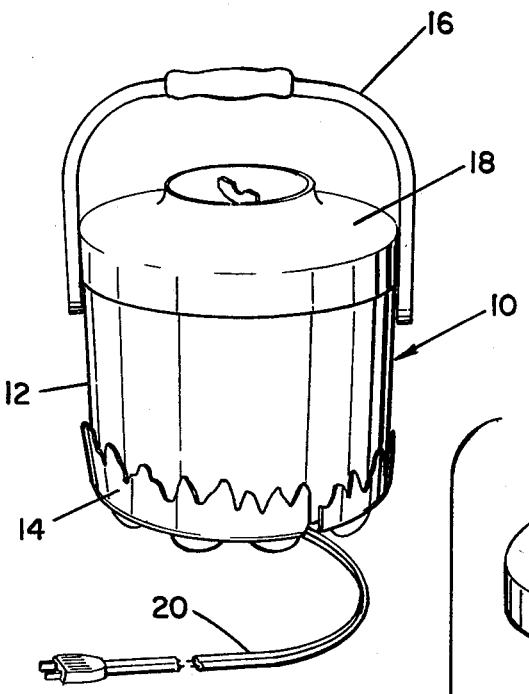
FIG. 1 is a perspective view of a toy molding apparatus according to the invention in its assembled condition.
Figure 2:
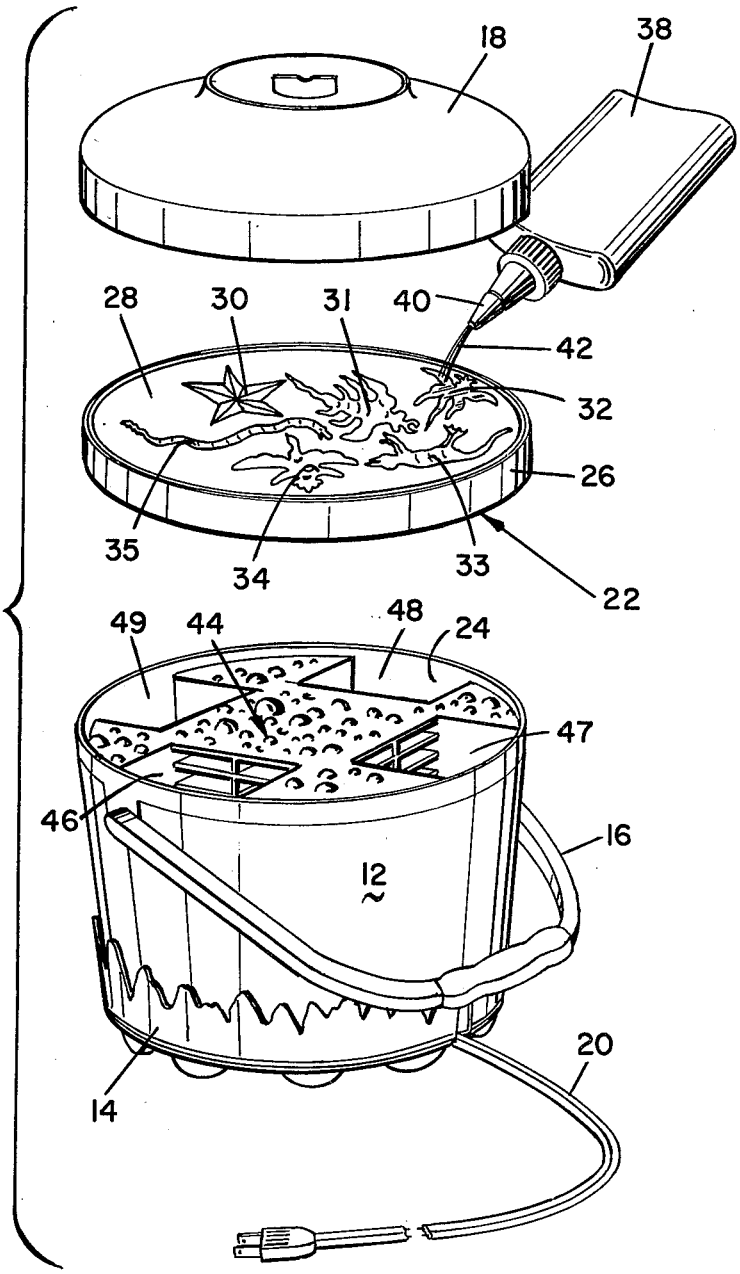
FIG. 2 is a partially exploded perspective view of the toy molding apparatus of FIG. 1.
Figure 4:
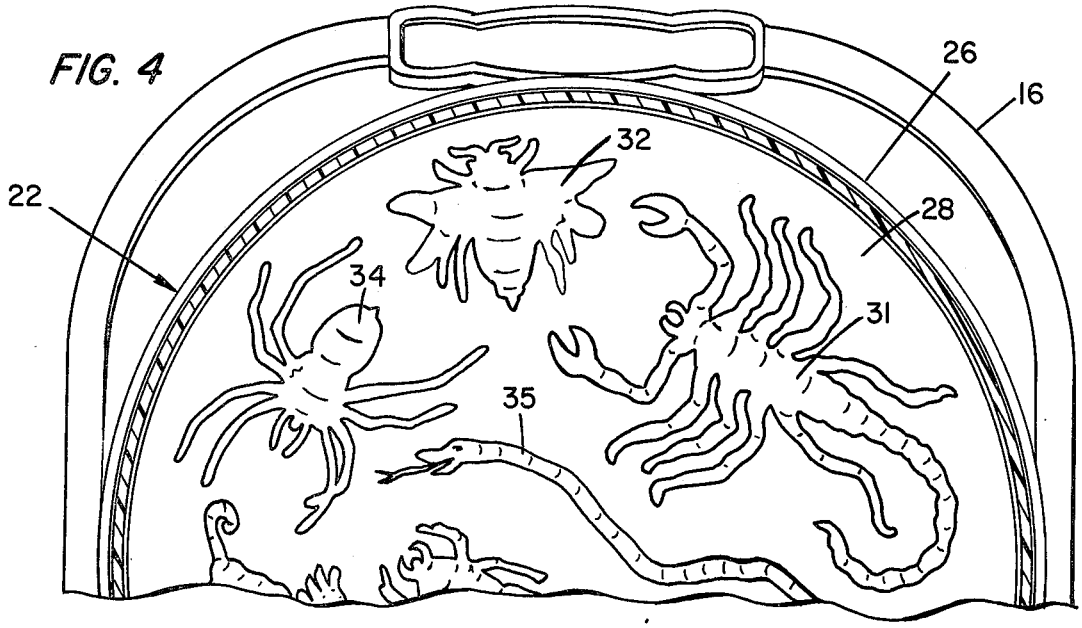
FIG. 4 is a partial top plan view generally along line 4—4 of FIG. 3.

Referring now to the drawings and particularly to FIGS. 1 and 2 there is shown a toy molding apparatus generally designated 10 including a housing 12 configured in the form of a pail or bucket with the bottom 14 thereof being suitably scalloped to simulate flames or the like. The toy 10 includes a handle 16 secured to the housing 12 for carrying the same with a lid or cover 18 encircling the top opening of the housing 12. An electrical cord 20 is provided for connection to a suitable source of alternating current for actuating the heat source as will hereinafter be described.

A separable mold member generally designated 22 is provided and has an outer configuration closely approximating the outer periphery of the opening 24 of the housing 12. In the form illustrated, the housing 12 of the molding apparatus toy 10 is generally circular in cross section with the mold member 22 being formed of an integral disc shaped member having a peripheral flange 26 in depending relation to the surface 28 thereof with the diameter of flange 26 being approximately the same as the diameter of opening 24 of the housing 12 for engaging the same as will hereinafter be described. Correspondingly, the flange portion 17 of the cover 18 has a diameter approximately the same as the diameter of the rim of flange 26 of the mold member 22 for engaging the same to provide an assembled unit capable of being carried by a child.

A surface 28 of mold member 22 is provided with a plurality of mold cavities 30–35, each of which is configured to form a different toy figure or creature. For example, cavity 30 is in the form of a star with cavity 35 in the form of a worm. In any event, as will hereinafter be described, a plastic squeeze bottle 38 is provided with a spout portion 40 for passage therethrough of a fluid composition 42 into each of the cavities 30–35 as desired by the child. Although, in FIG. 2, the mold member 22 is shown in exploded partially assembled relation with the housing 12, in actual use as will hereinafter be described, the mold member 22 will generally be maintained separate from the unit when in operation with the mold member 22 being maintained at room temperature for enabling the fluid composition 42 to solidify after pouring into the mold cavities 30–35. Furthermore, the material composition 42 is shown in fluid form being dispensed from the container or bottle 38, this fluid form being achieved upon heating the bottle 38 and the contents thereof within housing 12.

Figure 3:
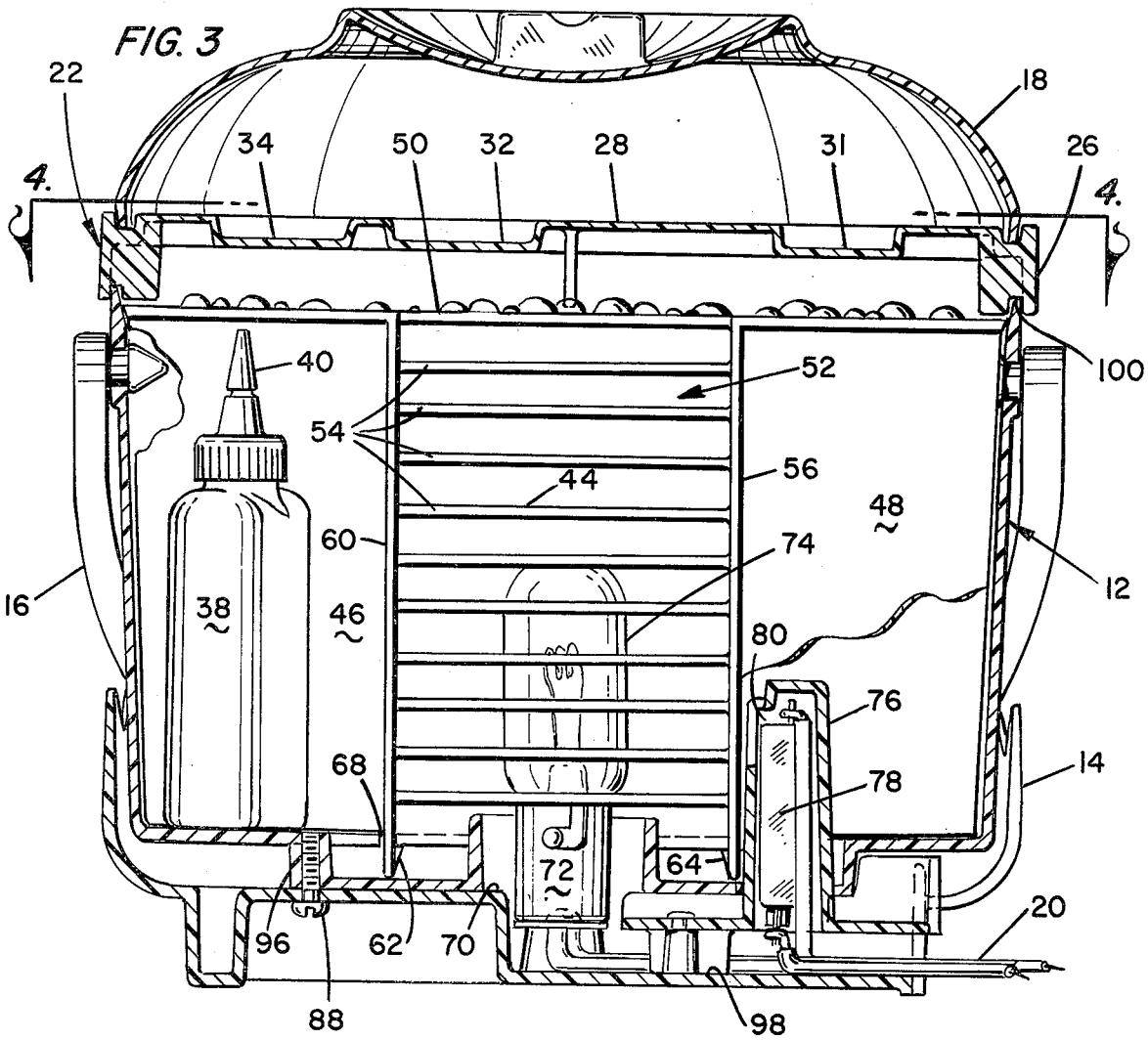
FIG. 3 is a cross sectional view of the toy molding apparatus of FIG. 1 taken generally on a plane through the center thereof.
Figure 5:
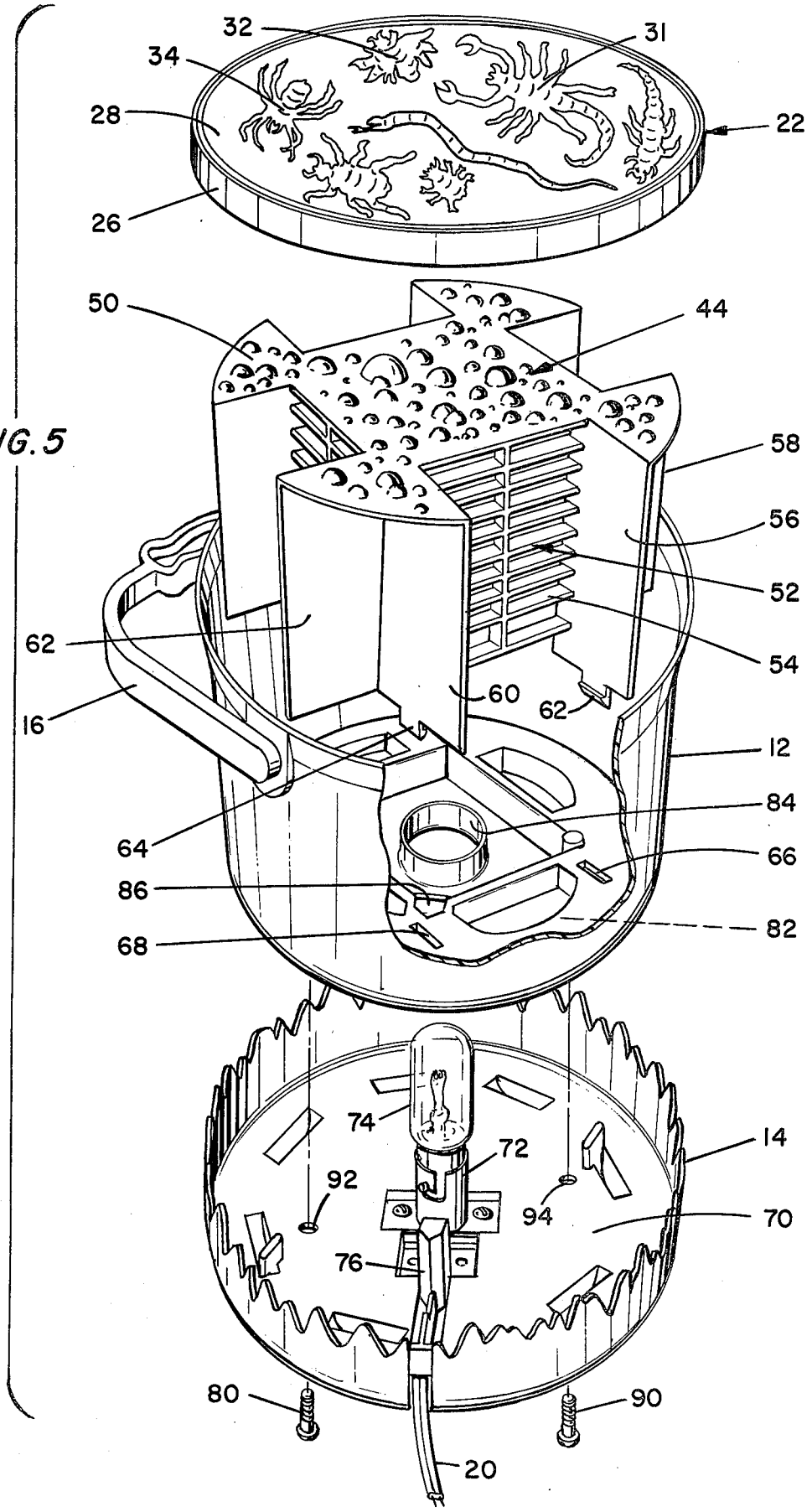
FIG. 5 is an exploded perspective view of the toy molding apparatus in disassembled relation without the cover member.

Positioned within the opening 24 of the housing 12 is a baffle member generally designated 44, and configured to provide a plurality of receptacles 46–49, each of which is generally identically configured for receiving therein one or more bottles 38, each of which may contain a composition of a different color for example. Referring specifically to FIGS. 3 and 5, the baffle member 44 has an upper surface 50 which is generally disc shaped with a plurality of bubble-like protuberances designed to simulate the surface of a boiling cauldron. The upper surface 50 has portions thereof cut away to define a generally rectangular core portion 52 having two pair of diametrically opposed sides facing the inner surface of the pail or housing 12. Each of the sides contains a plurality of slats or louvers 54, the louvers 54 being generally equally spaced and disposed relatively horizontally with each slat or louver 54 having a slant or tilt upwardly toward the upper surface 50. The spacing between louvers 54 is sufficiently small to prevent the insertion of objects or fingers into the interior of the housing 12 where the heat source is located. Extending outwardly from the core portion 52 adjacent each corner thereof are a pair of adjacent partitions 56 and 58 disposed perpendicular to each other with the long edges thereof being in abutting engagement with the inner surface of the pail or housing 12. The next corner as viewed in FIG. 5 likewise contains partitions 60 and 62 to form a quadrant with the spacing between partitions 56 and 60 defining one of the receptacles 46–49 for receiving the bottle 38 therein. Depending downwardly from the lower edges of partitions 56 and 60 are tab portions 62 and 64 respectively which pass through slots 66 and 68 respectively formed in the bottom of housing 12. Similar tabs are provided on opposite partitions for likewise securing the baffle member 44 within the housing 12. The interior of core portion 52 of baffle member 44 is hollow for passage of air therefrom through the open space between louvers 54 into the receptacles 46–49 to thereby disperse the heat generally upwardly and relatively uniformly.

The base or bottom 14 has a bottom plate portion 70 with an upwardly extending peripheral scalloped portion. Centrally disposed and secured to plate portion 70 is a socket 72 for receiving therein a suitable heat source such as a lamp 74 of the bayonet socket type. Also secured to the plate portion 70 is an upwardly extending thermostat housing 76 which receives therein a bi-metallic thermostat 78. The thermostat housing 76, as best seen in FIG. 3, is provided with a slot or opening 80 disposed inwardly toward the lamp 74 to sense the heat thereof and control the amount of power delivered to the lamp 74. The thermostat 78 is connected in series with one lead of the two wires connected electrically to socket 72, thereby acting as an on-off switch as the temperature rises. Typically, in this particular application, the thermostat will be set to open at a temperature of approximately 130–135° Fahrenheit. The electrical cord 20 is then suitably connected to both the thermostat 78 and socket 72 in a conventional manner.

The bottom of housing 12 is closed and formed with a plurality of downwardly extending rib portions 82 configured for abutting against the plate portion 70 with the lower portion of housing 12 received within the peripheral scalloped portion of the bottom 14. Centrally disposed within the bottom of the housing 12 is a circular opening 84 through which the bult 74 extends, the opening 84 being generally centrally disposed to position the bulb 74 within the central hollow part of core portion 52. An offset opening 86 is likewise formed in the bottom of housing 12 and configured for enabling the thermostat housing 76 to pass therethrough. Screw members 88 and 90 pass through apertures 92 and 94 respectively formed in the plate portion 70 of bottom 14 to threadably engage bosses 96 (only one of which is shown in FIG. 3) formed on the under surface of the bottom of housing 12.

In assembled relation, the toy molding apparatus 10 is shown in FIG. 3 with the tabs 62 and 64 of baffle member 44 passing through the respective slots 68 and 70, the tabs being barbed to provide engagement after insertion and to prevent withdrawal. The housing 12 is suitably secured to the plate portion 70 of base 14. As can be seen the plate portion 70 is formed with a suitable recess 98 to form a channel for passage therethrough of the electrical lead 20. The thermostat 78 is shown in position within thermostat housing 76 and the bulb 74 is secured within socket 72 with the bulb 74 being disposed centrally within the hollow interior of the core portion 52 of the baffle member 44. The mold member 22 is shown mounted on the opening 24 of the housing 12 with the under surface of rim or flange 26 having a peripheral circular recess 100 for resting on the upper edge of housing 12. The upper surface 28 of mold member 22 is provided with a peripheral lip, the inner periphery thereof receiving the lid or cover 18 in resting relation thereon. A bottle 38 is shown within receptacle 46 in position for heating the contents thereof. It is to be noted that the mold member 22, while shown resting on the opening 24 of housing 12, is not normally in this position when the bottle 38 and the contents thereof are being heated. For operation of the unit, one or more bottles 38 are placed in the receptacles 46–49 in the position shown in FIG. 3 for heating the contents thereof. During this time, the mold member 22 is separated from the unit with the periphery of cover 18 being inwardly tapered for abuttingly engaging the outwardly tapered periphery edge of the opening 24. The mold member 22 is generally kept at room temperature in order to facilitate the setting of the fluid 42 when poured into the respective cavities 30–35 formed in the surface thereof. Each of the housing 12, the bottom 14, the baffle member 44, and the cover 18 along with the mold member 22 are separate integral units, each being formed of a plastic material having a composition sufficient to withstand the operating temperatures of the unit. For use, the electrical cord 20 is plugged into a suitable household source of alternating current for energizing the heat source or light bulb 74 under control of the thermostat 78. One or more bottles 38 containing a gelatinous composition are placed in the receptacles 46–49 and with the heat generated by light bulb 74 and directed by the louvers 54 into the receptacle, the material within the bottle 38 is generally uniformly heated. Preferably, with the mold member 22 removed, the cover member 18 is positioned on the opening 24 of the housing 12 to control the dispersal of the heat throughout the receptacle. This process usually takes several minutes during which time the consistency of the fluid within the container 38 can be tested by simply squeezing the bottle which is of the plastic squeeze bottle variety normally utilized for containing glues or other similar compositions. The thermostat 78 senses the heat of the surrounding air passing through opening 80 of thermostat housing 76 with the bi-metallic element thereof opening when the temperature reaches the set point thereof which is approximately 130–135°. Repeated opening and closing of the thermostat 78 will maintain this temperature relatively constant.

When the composition within the bottle 38 reaches the desired consistency, the bottle 38 is then removed from its appropriate receptacle with the contents thereof being poured through spout 40 in fluid form into one or more of the mold cavities 30–35. With the mold member 32 separate from the unit and generally at room temperature, within a few minutes, the fluid 42 will gel and solidify to thereby create a toy figure or creature having an overall configuration similar to the cavity.

In the instant embodiment, the fluid 42 within the container 38 is a gelatinous substance consisting substantially of gelatin, glycerin and water with anti-bacterial preservatives added in small amount and appropriate pigmentation or color components, likewise in small amounts. The ingredients of the composition consist of edible gelatin in the range of 18 or 19 percent to 35 percent by weight; glycerin in the range of 10 percent to 25 percent by weight; water in the range of 40 percent to 65 percent; propylene glycol dipelargonate in the range of 0 to 2 percent by weight; methyl-p-hydroxybenzoate in the range of 0.05–0.35 percent by weight; propyl-p-hydroxybenzoate in the range of 0.05–0.35 percent by weight; imidazolidinyl urea compounds in the range of 0.1–1.5 percent by weight (such as a product of Ru Jac Inc. sold under the trade name "Germall 115"); and color components or pigments in the range of 0.1–2.5 percent by weight.

The preferred composition for the material contained within bottle 38 is as follows:

| MATERIAL | RANGE AS A PERCENT BY WEIGHT |
|---|---|
| Edible gelatin | 23–27% |
| Glycerin | 19% (approx.) |
| Water | 50–60% |
| Propylene Glycol Dipelargonate | 0.4% |
| Methyl-p-Hydroxybenzoate | 0.2% |
| Propyl-p-Hydroxybenzoate | 0.1% |
| Imidazolidinyl Urea Compound | 0.5% |
| Color Pigments | 0.1–2.5% |

The above material composition is generally solid at room temperature and consists substantially of gelatin, glycerin and water in the approximate proportion of 5:4:11 parts by weight respectively, with the balance of material therein being antibacterial or coloring agents. The relative proportions of gelatin, glycerin and water affect the high and low viscosity points, as well as melting temperature with the particular composition selected commencing to melt at 98–103° Fahrenheit with anything above 103° Fahrenheit being capable of being ejected from the bottle 38 by the application of pressure. At the lower temperatures the amount of pressure required to eject the composition will be much greater. As the temperature rises above 103° Fahrenheit, the fluid is less viscous and flows more readily until at about 130° Fahrenheit the fluid has the consistency of water. A preferred operating temperature is approximately 110° F., although the temperatures up to 130° F. will still be safe for handling. After pouring into the mold member 22, as the temperature of the material begins to drop, it will thicken until below 98° F. it will begin to solidify and fully set at room temperature. As soon as solidification commences, the creatures form within the mold cavities 30–35 can be removed and handled. The propylene glycol dipelargonate is added to the composition to enhance the feel of the material while the two hydroxybenzoate compounds are anti-bacterial as is "Germall 115".

Essentially, the toy according to the invention is a toy molding apparatus with a housing 12 configured in the form of a bucket with a baffle member 44 therein with a central hollow core portion having a heat source such as a lamp 74 therein in thermal communication through louvered sides of the core portion 52 to pass heat from the lamp 74 into receptacles 46–49 formed between adjacent parts of a baffle member 44 and the interior surface of housing 12, the receptacles receiving bottles 38 containing compositions which are generally solid at room temperatures with a fluid consistency at temperatures approximating 103° Fahrenheit or above. The heat can be retained within the housing 12 by enclosing the opening thereof by the mold member 22 or by the cover 18. The louvered portions of baffle member 44 have the louvers 54 thereof configured to direct the heat upwardly from the heat source for lamp 74 to disperse the air within the chamber or receptacle which contains the bottle 38. By utilizing the cover 18 to close the top opening 24 of the housing 12, the mold member 22 can be maintained separate from the unit during heating to hereby keep the mold member 22 at room temperatures to facilitate the setting of the compound within the bottle 38. Each of the mold cavities 30–35 formed within the surface 28 of mold member 22 can be configured in the form of crawling insects such as spiders or the like, or configured to simulate any other type figure. The particular apparatus may likewise be employed with the mold member 22 in the assembled position shown in FIG. 3 with each of the cavities containing a different material which may be for example fluid in its normal state but solid at an elevated temperature and with the mold member 22 configured to provide a spacing between the under surface of the various mold cavities and the upper surface 50 of baffle member 44, heat emanating from lamp 74 can pass through the receptacles for circulation in proximity to the under surface of mold member 22 to thereby provide a heat flow necessary to accomplish the intended result in this particular type application. While there has been shown and described a preferred embodiment, it is to be understood that various other adaptations and modifications may be made within the spirit and scope of the invention.

What is claimed is:

1. In a toy molding apparatus, the combination comprising:

a generally pail-shaped housing having an open top;

an electrical lamp mounted centrally within the bottom of said housing;

a baffle member within said housing and having a central core portion generally rectangular in cross section with each side having a plurality of louvers, said core portion substantially surrounding said electrical lamp, said baffle member having partitions extending outwardly from said core portion into abutting relation with the interior of said housing to provide at least one receptacle in thermal communication with said heat source whereby said louvers pass heated air from said lamp into said at least one receptacle;

a container having a heat-liquifiable substance therein, said container being configured for being received within said at least one receptacle for heating said substance; and cover means for substantially enclosing the open end of said housing for retaining the heat therein whereby to facilitate the heating of said container.

2. The combination according to claim 1 wherein said toy molding apparatus further includes a separate mold member having mold cavities for receiving the heated substance therein.

3. The combination according to claim 1 wherein said electrical lamp is electrically connected to thermostat means.

4. The combination according to claim 3 wherein said thermostat means is contained within a thermostat housing having an opening therein in thermal communication with said electrical lamp.

5. The combination according to claim 4 wherein said baffle member is configured to provide four receptacles and each of said sides and each of said receptacles is substantially identical in form.

6. The combination according to claim 1 wherein said liquifiable substance is a gelatinous substance normally generally solid at room temperature and fluid at temperatures of approximately 103° F. and greater.

7. The combination according to claim 6 wherein said gelatinous substance is a composition consisting substantially of gelatin, glycerin and water.

8. The combination according to claim 7 wherein said gelatinous substance is substantially approximately five parts by weight of gelatin, four parts by weight of glycerin, and eleven parts by weight of water.

9. The combination according to claim 7 wherein said gelatinous substance further includes anti-bacterial compounds and color pigments.

* * * * *